US011835049B2

(12) United States Patent
Shimizu

(10) Patent No.: US 11,835,049 B2
(45) Date of Patent: Dec. 5, 2023

(54) TURBO-MOLECULAR PUMP

(71) Applicant: SHIMADZU CORPORATION, Kyoto (JP)

(72) Inventor: Koichi Shimizu, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 49 days.

(21) Appl. No.: 17/494,901

(22) Filed: Oct. 6, 2021

(65) Prior Publication Data

US 2022/0136512 A1 May 5, 2022

(30) Foreign Application Priority Data

Oct. 29, 2020 (JP) ..... 2020-181473
May 13, 2021 (JP) ..... 2021-081477

(51) Int. Cl.
*F04D 19/04* (2006.01)
*F04D 27/00* (2006.01)
*F04D 29/58* (2006.01)

(52) U.S. Cl.
CPC ..... *F04D 19/042* (2013.01); *F04D 27/001* (2013.01); *F04D 29/582* (2013.01)

(58) Field of Classification Search
CPC ..... F04D 19/04–046; F04D 29/58–5853
See application file for complete search history.

(56) References Cited

U.S. PATENT DOCUMENTS

2012/0045261 A1* 2/2012 Mukai ..... G03G 15/2053 399/327
2015/0086328 A1 3/2015 Tsutsui
2015/0275914 A1 10/2015 Tsutsui
2017/0260999 A1* 9/2017 Kozaki ..... F04D 27/006
2021/0207619 A1* 7/2021 Miwata ..... F04D 29/522

FOREIGN PATENT DOCUMENTS

CN 104454569 A 3/2015
CN 104948475 A 9/2015
JP 2007-278192 A 10/2007
JP 2007278192 A * 10/2007

OTHER PUBLICATIONS

Office Action for corresponding TW Application No. 110133926 dated Mar. 4, 2022, with English language translation.
Office Action for corresponding Chinese Application No. 202111059554.5 dated Mar. 31, 2023, with English language machine translation.

* cited by examiner

*Primary Examiner* — David E Sosnowski
*Assistant Examiner* — Arthur Paul Golik
(74) *Attorney, Agent, or Firm* — Renner, Otto, Boisselle & Sklar, LLP

(57) ABSTRACT

A turbo-molecular pump comprises: a turbine pump portion having rotor blades and stator blades arranged in multiple stages in an axial direction; a drag pump portion provided on a downstream side of the turbine pump portion; a case housing the turbine pump portion; a base housing the drag pump portion; and a temperature adjustment unit provided between the case and the base. The temperature adjustment unit includes a temperature adjustment spacer forming a pump casing together with the case and the base and, the temperature adjustment unit includes a cooler, a heater, and a temperature detector which are provided at the temperature adjustment spacer.

20 Claims, 4 Drawing Sheets

TURBO-MOLECULAR PUMP

BACKGROUND OF THE INVENTION

1. Technical Field

The present invention relates to a turbo-molecular pump.

2. Background Art

A turbo-molecular pump includes a case housing a turbine pump portion and a base housing a drag pump portion. The drag pump portion is under a lower vacuum than that of the turbine pump portion, and for this reason, a reactive product is easily accumulated. Thus, a heater for reducing accumulation of the reactive product is provided at the base, and the temperature of the drag pump portion is heated to equal to or higher than the sublimation temperature of gas.

As a pump load increases, the temperature of a rotor blade of the turbine pump portion increases. Most of heat of the rotor blade is transferred to a stator blade, and heat of the stator blade is transferred to the case. A turbo-molecular pump configured such that a coolant water pipeline is provided near a fastening portion between the base and the case for preventing an increase in the temperature of the rotor blade by a predetermined value or more has been known (see, e.g., Patent Literature 1 (JP-A-2007-278192)).

In the above-described typical turbo-molecular pump, the stator blade is cooled by coolant water flowing in a coolant water pipe provided at a boundary portion between the case and the base so that an increase in the temperature of the rotor blade can be prevented. However, if the stator blade is excessively cooled by coolant water, a reactive product is accumulated on the stator blade, and for this reason, stator blade temperature control needs to be properly performed.

However, in the typical turbo-molecular pump configured such that the coolant water pipe is arranged at the boundary portion between the case and the base, it is difficult to adjust the temperature of the stator blade with a favorable accuracy.

SUMMARY OF THE INVENTION

A turbo-molecular pump comprises: a turbine pump portion having rotor blades and stator blades arranged in multiple stages in an axial direction; a drag pump portion provided on a downstream side of the turbine pump portion; a case housing the turbine pump portion; a base housing the drag pump portion; and a temperature adjustment unit provided between the case and the base. The temperature adjustment unit includes a temperature adjustment spacer forming a pump casing together with the case and the base and, the temperature adjustment unit includes a cooler, a heater, and a temperature detector which are provided at the temperature adjustment spacer.

According to a turbo-molecular pump of the present invention, controllability of the temperatures of downstream stator blades of a turbine pump portion is improved.

DETAILED DESCRIPTION OF THE EXEMPLARY EMBODIMENTS

Hereinafter, an embodiment of a turbo-molecular pump of the present invention will be described with reference to the drawings.

Figure 1:
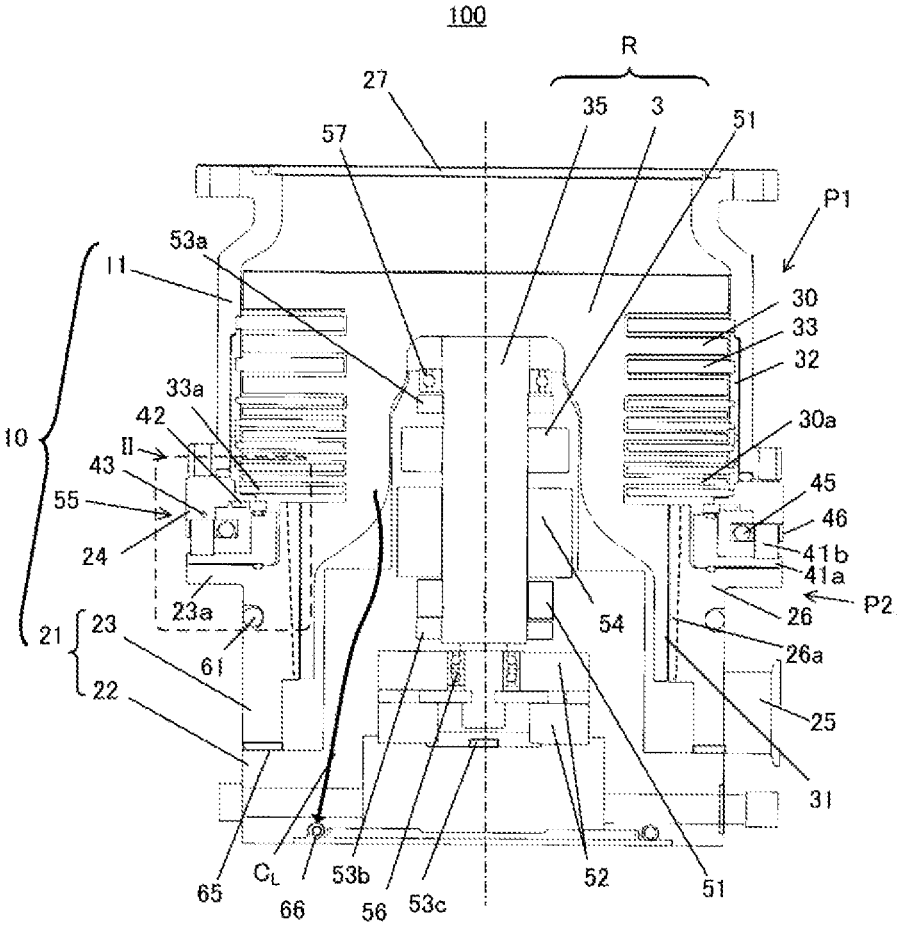
FIG. 1 is a sectional view showing one embodiment of a turbo-molecular pump according to the present invention.

FIG. 1 is a sectional view showing one embodiment of the turbo-molecular pump according to the present invention.

(Entire Turbo-Molecular Pump Configuration)

The turbo-molecular pump 100 discharges gas from a vacuuming chamber by a drag pump portion P2 and a turbine pump portion P1 provided in a casing 10. The casing 10 is, as a hermetic case, formed of a case 11, a base 21, and a temperature adjustment unit 55 arranged therebetween. The turbine pump portion P1 is housed in the case 11, and the drag pump portion P2 is housed in the base 21.

The turbo-molecular pump 100 is attached to the not-shown vacuuming chamber through a suction opening 27 of the case 11, and sucks gas from the vacuuming chamber through the suction opening 27 and discharges the gas through an exhaust opening of an exhaust port 25 provided at a base portion 22 to control the internal pressure of the vacuuming chamber.

(Entire Base Configuration)

The base 21 includes the base portion 22 (a first member) and a housing 23 (a second member). A motor 54, a bearing device and the like are provided at a spindle portion of a center portion of the base portion 22, and the cylindrical housing 23 is fixed to an outer-peripheral-side flange portion through a heat insulator 65. A flange 23*a* is provided at an outer peripheral portion of an upper portion of the housing 23, the temperature adjustment unit 55 is arranged on an upper surface of the flange 23*a*, and the case 11 is provided on an upper surface of the temperature adjustment unit 55. As described above, in the present embodiment, the temperature adjustment unit 55 is provided between the base 21 and the case 11, i.e., is provided to surround the vicinity of a connection portion between the drag pump portion P2 and the turbine pump portion P1. Specifically, the temperature adjustment unit 55 properly controls, e.g., the temperatures of rotor blades 30 and stator blades 33 provided on a lower stage side of the turbine pump portion P1. Although described later in detail, the temperature adjustment unit 55 includes, unlike a typical turbo-molecular pump, a heater 42 (a heater), a coolant water pipe 45 (a cooler), and a temperature detector 43.

(Turbine Pump Portion P1)

The turbine pump portion P1 includes multiple stages of the rotor blades 30 formed at a rotor 3 and multiple stages of the stator blades 33 provided on a case 11 side. The rotor blades 30 and the stator blades 33 are alternately arranged in an axial direction. Each stator blade 33 is stacked and fixed with an outer-peripheral-side peripheral edge of the stator blade 33 being sandwiched by spacers 32.

Note that as shown in FIG. 1, the lowermost stator blade 33*a* of the stator blades 33 forming the turbine pump portion P1 is positioned below (a downstream side) a lower surface of the case 11, specifically inside the temperature adjustment unit 55. A structure may be employed, in which the entirety of the turbine pump portion P1 including the lowermost stator blade 33*a* is housed in the case 11. That is, it may only be required that the turbine pump portion P1 has such a structure that the substantially entirety thereof is housed in the case 11.

Note that the lowermost rotor blade 30*a* is provided on an upper side of the lowermost stator blade 33*a*.

(Drag Pump Portion P2)

The drag pump portion P2 is provided on the downstream side of the turbine pump portion P1. The drag pump portion P2 includes a rotor cylindrical portion 31 formed integrally with the rotor 3 and a screw stator portion 26 formed integrally with the housing 23. A screw groove 26*a* is provided at a surface of the screw stator portion 26 facing the rotor cylindrical portion 31. The screw groove 26*a* may be provided at an outer peripheral surface of the rotor cylindrical portion 31. Screw grooves may be provided at both opposing surfaces of the screw stator portion 26 and the rotor cylindrical portion 31.

(Rotor 3)

The rotor 3 is fastened to a shaft 35 as a rotor shaft through a fastening member (not shown) such as a bolt, and is integrated with the shaft 35. The rotor 3 and the shaft 35 form a rotary body R. The shaft 35 is rotatably driven by the motor 54 provided at the spindle portion of the base portion 22. The shaft 35 is supported in a non-contact manner by magnetic bearings 51 (two locations) in a radial direction and magnetic bearings 52 (a pair of upper and lower bearings) in a thrust direction. A levitation position of the shaft 35 is detected by radial displacement sensors 53*a*, 53*b* and an axial displacement sensor 53*c*. The shaft 35, i.e., the rotary body R, rotatably magnetically levitated by the magnetic bearings 51, 52 is rotatably driven at a high speed by the motor 54.

When the magnetic bearings 51, 52 are not in operation, the shaft 35, i.e., the rotary body R, is supported by mechanical bearings 56, 57. The mechanical bearings 56, 57 are emergency mechanical bearings.

(Temperature Control Structure for Base 21)

The drag pump portion P2 is, by a heater 61 wound around the outer periphery of the housing 23, temperature-adjusted to equal to or higher than the sublimation temperature of gas to be discharged such that no reactive product is accumulated. As described above, the heat insulator 65 is interposed between the housing 23 and the base portion 22 such that no heat of the housing 23 is transferred to the base portion 22. The heat insulator 65 is made of a material having a lower thermal conductivity than that of any of the base portion 22 and the housing 23. The heat insulator 65 has the function of hermetically sealing a gas flow path in the vacuum pump from the outside and the function of thermally insulating the base portion 22 and the housing 23 from each other. A structure may be employed, in which the heat insulator 65 has only the heat insulation function and the hermetic sealing function is substituted with an O-ring as another member.

A coolant water pipe 66 is provided on a bottom side of the base portion 22. The base portion 22, the motor 54 and the like are cooled by coolant water flowing in the coolant water pipe 66. Although described later, inner peripheral surfaces of the rotor blades 30, i.e., an inner peripheral surface of an upper region of the rotor 3, are close to the spindle portion at the center of the base portion 22, and heat of the rotor 3 is radiated and transferred to the spindle portion of the base portion 22. Thus, the rotor 3 is cooled by coolant water flowing in the coolant water pipe 66.

The housing 23 and the base portion 22 are thermally separated from each other by the heat insulator 65, and in other words, heat transfer between the housing 23 and the base portion 22 is blocked or reduced. Thus, the base portion 22 can be cooled to a temperature lower than the temperature of the housing 23.

For example, the base portion 22 can be temperature-adjusted to about 40° C. to 60° C. by cooling with coolant water at a room temperature (about 15° C. to 25° C.), and the housing 23 can be temperature-adjusted to about 140° C. to 160° C. by the heater 61.

In the case of a structure in which the base portion 22 and the housing 23 contact each other without use of the heat insulator 65 employed in the present embodiment, if the temperature of the drag pump portion P2, i.e., a target temperature of the housing 23, is high, heat of the housing 23 is transferred to the base portion 22, and as a result, the temperature of the motor 54 also increases. For this reason, the performance of the motor 54 needs to be suppressed.

Thus, in the present embodiment, the heat insulator 65 is arranged between the housing 23 and the base portion 22 such that heat accompanied by the temperature of the housing 23 is not transferred to the base portion 22. That is, there is no need to suppress the capacity of the motor 54 by suppression of an increase in the temperature of the motor 54 fixed to the base portion 22.

As described above, accumulation of the reactive product can be prevented in such a manner that a target temperature of the drag pump portion P2 is set to a higher temperature as an exhaust flow rate increases while the performance of the motor 54 fixed to the base portion 22 is fully utilized.

(Temperature Adjustment Unit 55)

The temperature adjustment unit 55 includes a first heat insulator 41*a*, a second heat insulator 41*b*, a temperature adjustment spacer 24, the coolant water pipe 45 provided at a cooling spacer 46, the heater 42, and the temperature detector 43.

(First Heat Insulator 41*a*)

Figure 2:
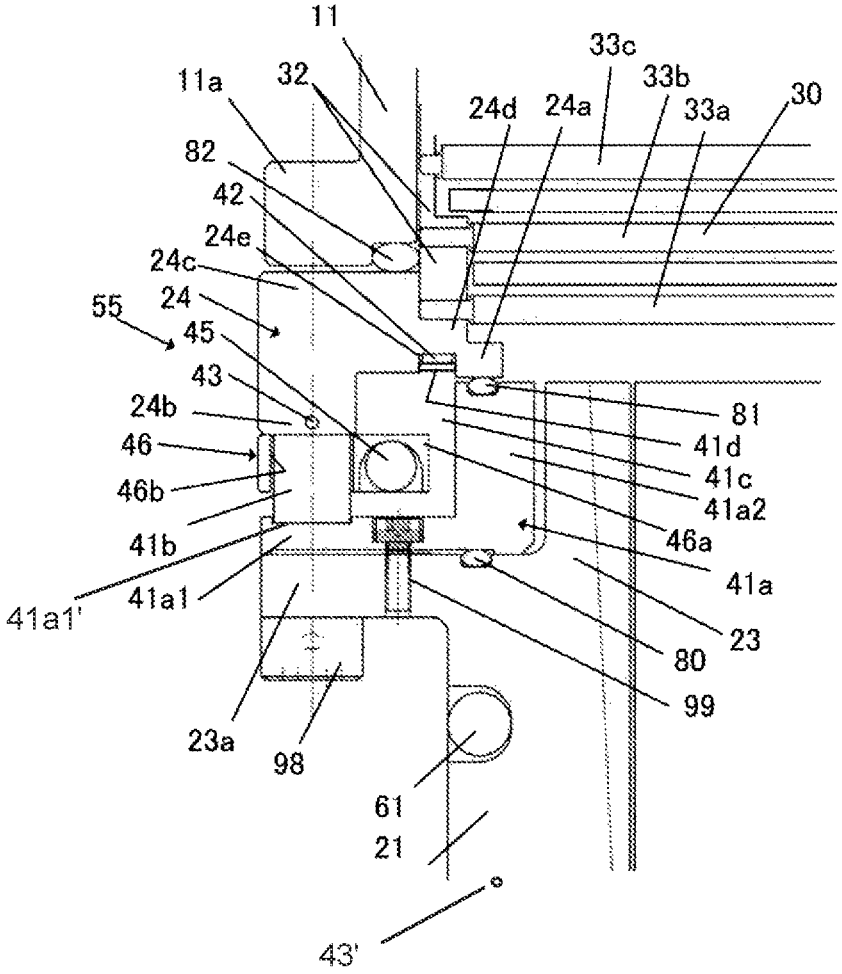
FIG. 2 is an enlarged view of a region II of the turbo-molecular pump shown in FIG. 1.

As shown in FIG. 2, the first heat insulator 41*a* (one example of a heat insulator) is an annular ring member having a thin eave portion 41*a*1 and a vertical wall portion 41*a*2 and having an inverted L-shaped section. The first heat insulator 41*a* is fixed to the flange 23*a* of the housing 23 with a bolt 99. Of the vertical wall portion 41*a*2, a lower surface is provided in contact with the flange 23*a* of the housing 23 through an O-ring 80, and an upper end surface contacts the temperature adjustment spacer 24 through an O-ring 81. By fastening with the bolt 99, the O-ring 80 is compressed to seal a portion between the housing 23 and the first heat insulator 41*a*.

(Second Heat Insulator 41*b*)

The second heat insulator 41*b* (one example of the heat insulator) has a ring shape with a rectangular section, and is placed in contact with a recessed portion 41*a*1' formed at an upper surface of the eave portion 41*a*1 of the first heat insulator 41*a*. The temperature adjustment spacer 24 is placed in contact with an upper end surface of the second heat insulator 41*b*. The second heat insulator 41*b* is arranged at a position apart from the vertical wall portion 41*a*2 of the first heat insulator 41*a* in the radial direction, and a space 41*c* is formed between the second heat insulator 41*b* and the vertical wall portion 41*a*2.

The first heat insulator 41*a* and the second heat insulator 41*b* are, for example, made of ceramic or resin with a low thermal conductivity. Note that these insulators are not limited to such a material and other materials may be employed as long as these materials have lower thermal conductivities (higher thermal resistances) than those of the housing 23 and the temperature adjustment spacer 24.

In the embodiment, the substantially entirety of an outer peripheral surface of the housing 23 above (an upstream side) the flange 23*a* is covered with the first heat insulator 41*a* having the inverted L-shaped section. In addition, on the outside of the first heat insulator 41*a*, the temperature adjustment spacer 24 is further provided above the first heat insulator 41*a* with the second heat insulator 41*b* being interposed therebetween. Thus, heat insulation (reduction in heat transfer) between the housing 23 and the temperature adjustment spacer 24 can be reliably provided.

(Temperature Adjustment Spacer 24)

The temperature adjustment spacer 24 is an annular member having a shown sectional shape. The temperature adjustment spacer 24 includes a lower inner contact portion 24*a* contacting the first heat insulator 41*a*, a lower outer contact portion 24*b* contacting the second heat insulator 41*b*, and an upper contact portion 24*c* contacting a flange portion 11*a* of the case 11. The case 11 is placed on the upper contact portion 24*c* through an O-ring 82. The case 11, the temperature adjustment spacer 24, the first heat insulator 41*a*, and the second heat insulator 41*b* are fastened together by a bolt 98 penetrating these components. By such fastening with the bolt 98, the O-ring 82 is compressed to seal a portion between the case 11 and the temperature adjustment spacer 24, and the O-ring 81 is compressed to seal a portion between the temperature adjustment spacer 24 and the first heat insulator 41*a*. With three O-rings 80, 81, 82, the temperature adjustment unit 55 is interposed between the base 21 and the case 11 such that the temperature adjustment unit 55, the case 11, and the base 21 together form the casing 10.

Note that the case 11, the temperature adjustment spacer 24, and the base 21 are integrated by axial force of the bolt 98 and the multiple stages of the stator blades 33 and the spacers 32 are accordingly pressed and sandwiched between the case 11 and the temperature adjustment spacer 24. Heat of the multiple stages of the stator blades 33 moves to the temperature adjustment spacer 24 by way of the spacers 32. On the upstream side with respect to the second stator blade 33*b* from the bottom, a heat transfer path from the stator blade is also formed at the case 11. Thus, heat also moves from the flange portion 11*a* of the case 11 to the upper contact portion 24*c* of the temperature adjustment spacer 24.

The temperature adjustment spacer 24 is configured such that a stator blade placing portion 24*d* is provided in a connection region between the lower inner contact portion 24*a* and the upper contact portion 24*c*. The lowermost stator blade 33*a* is placed on the stator blade placing portion 24*d*, and the second stator blade 33*b* from the bottom is provided on an upper surface of an outer peripheral edge of the stator blade 33*a* through the spacer 32. Further, the third stator blade 33*c* from the bottom is provided on an upper surface of an outer peripheral edge of the stator blade 33*b* through the spacer 32.

(Heater 42)

At the temperature adjustment spacer 24, a heater placing recessed portion 24*e* is provided facing the space 41*c* at a position close to the lower inner contact portion 24*a* between the lower inner contact portion 24*a* and the lower outer contact portion 24*b*. The heater 42 is provided in the recessed portion 24*e*. The heater 42 is formed in a ring shape surrounding the outer periphery of the vertical wall portion 41*a*2 of the first heat insulator 41*a*. Note that a heat insulator 41*d* (one example of a fourth heat insulator) is provided on a space 41*c* side of the heater 42 such that heat of the heater 42 is efficiently input to the temperature adjustment spacer 24. In FIG. 2, the heater placing recessed portion 24*e* is provided in a region facing the stator blade placing portion 24*d*. Heat of the heater 42 is transferred to the stator blade placing portion 24*d* right above the heater 42 to efficiently heat the lowermost stator blade 33*a*. The placement position of the heater 42 is not limited to the position shown in FIG. 2, and it may only be required that the temperature adjustment spacer 24 can be heated to heat the downstream stator blades 33, including the lowermost stator blade 33*a*, of the turbine pump portion P1.

(Coolant Water Pipe 45)

The cooling spacer 46 provided with the coolant water pipe 45 is attached to the second heat insulator 41*b* through, e.g., a not-shown fastening member. A housing portion 46*a* housing the coolant water pipe 45 and an opening 46*b* into which the second heat insulator 41*b* is inserted are provided at the cooling spacer 46. The cooling spacer 46 and the coolant water pipe 45 are formed in ring shapes surrounding the substantially entire periphery of the vertical wall portion 41*a*2 of the first heat insulator 41*a*. The second heat insulator 41*b* reduces transfer of heat of the housing 23 to the temperature adjustment spacer 24.

The cooling spacer 46 cooled by the coolant water pipe 45 is provided in contact with the temperature adjustment spacer 24. As a result, the temperature adjustment spacer 24 is cooled.

Note that the first and second heat insulators 41*a*, 41*b* are provided between the housing 23 and the coolant water pipe 45 and evaporation of liquid coolant, such as water, flowing in the coolant water pipe 45 can be accordingly prevented even when the temperature of the housing 23 suddenly reaches a high temperature.

(Temperature detector 43)

The temperature detector 43 is provided near a surface of the lower outer contact portion 24*b* of the temperature adjustment spacer 24 contacting the second heat insulator 41*b*. The temperature of the temperature adjustment spacer 24 increases due to influence of heat of the turbine pump portion P1, influence of heat of the housing 23, and influence of heat of the heater 42, and decreases by coolant water flowing in the coolant water pipe 45. The temperature detector 43 detects such fluctuation in the temperature of the lower outer contact portion 24*b* of the temperature adjustment spacer 24.

(Temperature Control of Temperature Adjustment Unit 55)

(Heating Control and Cooling Control According to Lower Limit Threshold Temperature and Upper Limit Threshold Temperature)

According to the temperature detected by the temperature detector 43, the heater 42 is turned on/off, and the flow rate of coolant water flowing in the coolant water pipe 45 is adjusted.

The temperature of the stator blade 33 is adjusted to a temperature between a lower limit threshold temperature and an upper limit threshold temperature. In the turbomolecular pump 100 according to the present embodiment, the temperature of the housing 23 is maintained at about 140° C. to 160° C., and the temperature of the stator blade 33 is maintained at equal to or lower than about 100° C. to 120° C. Thus, the lower limit threshold temperature is 90° C., and the upper limit threshold temperature is 120° C., for example.

When the temperature detector 43 detects that the temperature of the temperature adjustment spacer 24 is the lower limit threshold temperature, the heater 42 is turned on, i.e., power is distributed to the heater 42, according to a signal from a not-shown control circuit. Accordingly, the heater 42 heats the temperature adjustment spacer 24, and the lowermost stator blade 33*a* is heated. The lower limit threshold temperature is a temperature equal to the sublimation temperature of gas under a gas pressure on the downstream side of the turbine pump portion P1.

After the heater 42 has been turned on, when the temperature detector 43 detects that the temperature of the temperature adjustment spacer 24 is a heater-off threshold temperature higher than the lower limit threshold temperature by a predetermined value, the heater 42 is turned off according to a signal from the not-shown control circuit.

When the temperature detector 43 detects that the temperature of the temperature adjustment spacer 24 is the upper limit threshold temperature, a fluid circuit is controlled such that the coolant water flow rate increases. For example, an on-off valve is provided at a flow path for supplying coolant water to the coolant water pipe 45 so that the coolant water flow rate can be adjusted by the control of opening/closing the flow path. Alternatively, the flow rate may be adjusted by a flow rate adjustment valve instead of the on-off valve, or the technique of controlling the amount of discharge from a coolant water pump may be employed. The upper limit threshold temperature is a temperature set for reducing a creep phenomenon of the rotor blade 30.

After cooling with coolant water has started, when the temperature detector 43 detects that the temperature of the temperature adjustment spacer 24 is a cooling stop threshold temperature lower than the upper limit threshold temperature by a predetermined value, the control of increasing the coolant water flow rate ends according to a signal from the not-shown control circuit.

(Equipment Arrangement considering Responsiveness of Temperature Adjustment by Coolant Water and Responsiveness of Temperature Adjustment by Heater)

The heater 42, the temperature detector 43, and the coolant water pipe 45 are arranged in this order from the lowermost stator blade 33*a* to the downstream side of exhaust gas. With respect to the position of the lowermost stator blade 33*a*, the heater 42 is arranged at a near position, and the coolant water pipe 45 is arranged at a far position. As described above, the temperature detector 43 is arranged near the lower outer contact portion 24*b* of the temperature adjustment spacer 24. In other words, the temperature detector 43 is arranged between the heater 42 and the coolant water pipe 45. The temperature detector 43 is not arranged at a position with an equal distance from the heater 42 and the coolant water pipe 45, but is arranged at a position closer to the coolant water pipe 45 than to the heater 42.

In the turbo-molecular pump 100, the cooling capacity of coolant water flowing in the coolant water pipe is normally greater than the heating capacity of the heater. In other words, the rate of increase in the temperature of the stator blade 33 by the heater is lower than the rate of decrease in the temperature of the stator blade 33 by coolant water. In the present embodiment, the temperature detector 43 is arranged at the position closer to the coolant water pipe 45 than to the heater 42, and therefore, when the temperature of the temperature adjustment spacer 24 is decreased by coolant water flowing in the coolant water pipe 45, such temperature fluctuation is quickly detected by the temperature detector 43. Thus, when the above-described cooling stop threshold temperature is detected, the control of increasing coolant water ends, and therefore, excessive cooling is easily prevented. As a result, the function of reducing accumulation of the reactive product can be more improved, and high-accuracy temperature adjustment can be performed.

In a case where the temperature detector 43 is near the heater 42, after cooling has started because of the temperature exceeding the upper limit threshold temperature (e.g., 140° C.), the temperature detector 43 cannot promptly detect such a state even when the temperature of the stator blade has actually reached the cooling stop threshold temperature. Thus, in some cases, cooling ends after the stator blade has reached a temperature lower than the cooling stop threshold temperature, and accumulation of the reactive product increases.

(Improvement of Temperature Responsiveness of Heater 42)

In a turbo-molecular pump configured such that a case is heated by a heater for preventing accumulation of a reactive product on a turbine pump portion P1, the size of the heater is determined considering the heat capacity of a casing such as the case. In this case, if the case is a casing placed in contact with a base, the heat capacity of the base is also taken into consideration, and the size of the heater increases.

In the turbo-molecular pump of the embodiment, the case 11 and the housing 23 of the base 21 are thermally insulated from each other by the first heat insulator 41*a* and the second heat insulator 41*b*, and therefore, the heat capacity of the case 11 is smaller than the heat capacity of the casing structure in which the case 11 and the base 21 are not thermally insulated from each other. Thus, by the small heater 42, the temperature of the turbine pump portion P1 can be quickly increased. That is, the temperature responsiveness of the heater 42 is improved.

Note that the case where the cooling capacity of the cooler is greater than the heating capacity of the heater has been described above as an example, but conversely, a structure in which the heating capacity of the heater is greater than the cooling capacity of the cooler can be employed. In this case, the temperature detector 43 is preferably arranged at a position closer to the heater than to the cooler.

(Temperature Adjustment Control of Temperature Adjustment Plate and Temperature Adjustment Control of Base)

As described above, the temperature adjustment control of the temperature adjustment spacer 24 is performed according to the result of detection of the temperature detector 43. On the other hand, the temperature adjustment control of the heater 61 placed at the housing 23 is performed according to a detection signal of another temperature detector 43' different from the temperature detector 43. Thus, temperature adjustment of the turbine pump portion P1 and temperature adjustment of the drag pump portion P2 are independently performed.

Features and advantageous effects of the turbo-molecular pump according to the above-described embodiment are as follows.

(1) The turbo-molecular pump of the embodiment includes the temperature adjustment spacer 24 forming the pump casing 10 together with the case 11 housing the turbine pump portion P1 and the base 21 housing the drag pump portion P2. The coolant water pipe 45 (the cooler), the heater 42 (the heater), and the temperature detector 43 are provided at the temperature adjustment spacer 24.

With this configuration, the temperatures of the downstream stator blades 33, including the lowermost stator blade 33*a*, of the turbine pump portion P1 can be controlled with a favorable accuracy.

(2) The turbo-molecular pump of (1) includes the heater 42, the temperature detector 43, and the coolant water pipe 45 arranged in this order along a gas flow direction.

With this configuration, the temperatures of the downstream stator blades 33, including the lowermost stator blade 33*a*, of the turbine pump portion P1 can be controlled with a favorable accuracy.

(3) In the turbo-molecular pump of (1), the temperature detector 43 is arranged at the position closer to the coolant water pipe 45 than to the heater 42.

With this configuration, the downstream stator blades 33 of the turbine pump portion P1 is not excessively cooled, and accumulation of the reactive product is prevented.

(4) In the turbo-molecular pump of any one of (1) to (3), the coolant water pipe 45 of the temperature adjustment unit 55 is thermally insulated from the base 21 by the second heat insulator 41*b*. Thus, the coolant water pipe 45 can cool only the temperature adjustment spacer 24 without cooling the base 21, and can be reduced in size.

(5) In the turbo-molecular pump of (4), the heater 61 configured to heat the drag pump portion P2 is provided separately from the heater 42 of the temperature adjustment unit 55.

With this configuration, the heater 61 of the drag pump portion P2 prevents accumulation of the reactive product on the drag pump portion P2. The heater 42 of the temperature adjustment unit 55 prevents accumulation of the reactive product on, e.g., the downstream stator blades 33 of the turbine pump portion P1. Thus, accumulation of the reactive product on both of the turbine pump portion and the drag pump portion can be effectively prevented.

(6) In the turbo-molecular pump of (5), the base 21 includes the base portion 22 supporting the motor 54 rotatably driving the rotor blades 30 and the housing 23 thermally separated from the base portion 22 and provided such that the heater 61 configured to heat the drag pump portion P2 is provided at the housing 23. Even if the housing 23 is heated for prevention of accumulation of the reactive product on the drag pump portion P2, the base portion 22 is not heated, and therefore, the performance of the motor 54 provided at the base 21 does not need to be suppressed.

(7) In the turbo-molecular pump of (6), the heater 42 provided at the temperature adjustment unit 55 heats the stator blades 33 to a temperature lower than a temperature to which the drag pump portion P2 is heated by the heater 61 provided at the base 21.

Thus, there is no risk that the downstream stator blades 33 of the turbine pump portion P1 are heated more than necessary, and creep deterioration of the rotor blade can be reduced.

(8) In the turbo-molecular pump of any one of (1) to (7), drive of the heater 42 and the coolant water pipe 45 of the temperature adjustment unit 55 is controlled based on the detection result of the temperature detector 43 provided at the temperature adjustment unit 55.

(9) In the turbo-molecular pump of (8), the heater 61 provided at the housing 23 is controlled based on another temperature detector different from the temperature detector 43 of the temperature adjustment unit 55. In other words, the heater 42 of the temperature adjustment unit 55 is controlled independently of the heating control of the drag pump portion P2. Thus, the accuracy of the temperature of the stator blade 33 of the turbine pump portion P1 is improved.

First Variation

Figure 3:
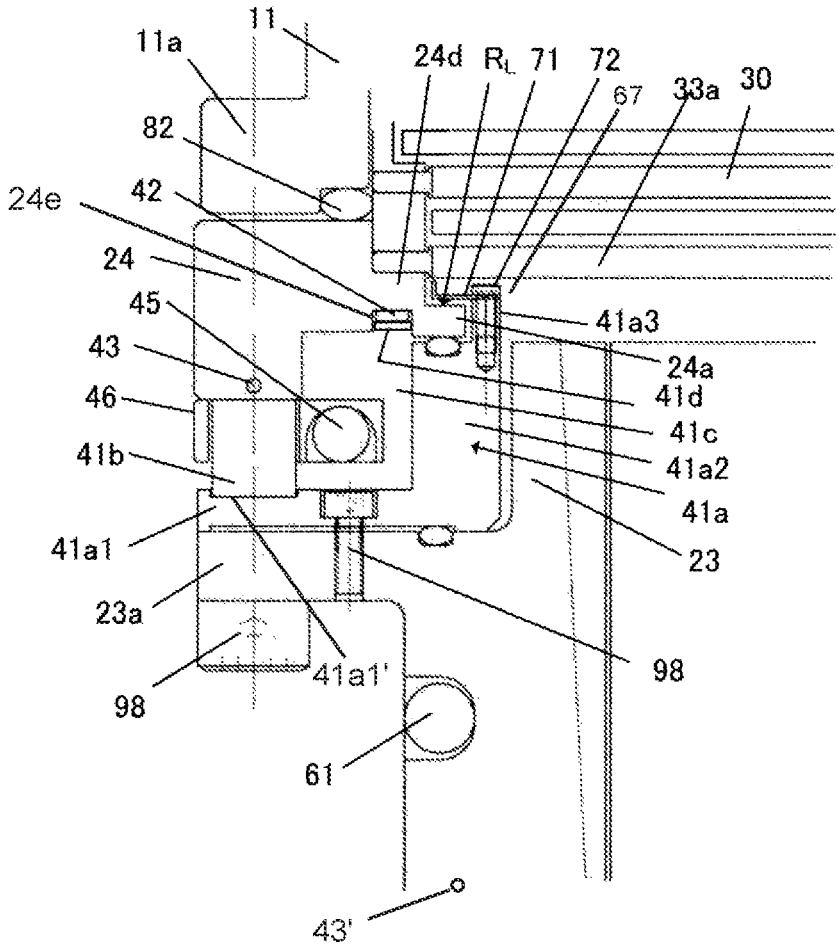
FIG. 3 is a view showing a first variation of the region II of the turbo-molecular pump according to the present invention.

FIG. 3 is a view showing a variation of a region II of the turbo-molecular pump according to the present invention.

In the variation shown in FIG. 3, a surface of the temperature adjustment spacer 24 exposed to the gas flow path 67 is covered with a cover 71.

When a great load is on the gas flow path of the turbine pump portion P1 by an increase in the exhaust amount, the temperatures of the rotor blades 30 increase to transfer much heat to the stator blades 33. For this reason, the temperatures of the stator blades 33, particularly the temperature of the lowermost stator blade 33*a*, increases, and a frequency that the temperature detected by the temperature detector 43 reaches the upper limit threshold temperature increases. As a result, the frequency of the flow of coolant water in the coolant water pipe 45 increases. The temperature of a region RL facing the gas flow path from the stator blade placing portion 24*d* of the temperature adjustment spacer 24 to the lower inner contact portion 24*a* of the temperature adjustment spacer 24 is lowest in the gas flow path in the turbo-molecular pump 100. For example, Temperature of Region RL<Temperature of Cover 71≤Temperature of First Heat Insulator 41*a* is satisfied. Thus, in some cases, reactive gas accumulation is caused in the region RL.

In the first variation, the surface of the temperature adjustment spacer 24 exposed to the gas flow path is covered with the cover 71 on the most downstream side of the gas flow path such that no accumulation is caused in the region RL where an inner peripheral surface of the temperature adjustment spacer 24 faces the gas flow path. The cover 71 is formed in a dish shape having a circular opening at the center. The cover 71 can be formed of a thin metal plate. Multiple fastening holes are provided in a circumferential direction along an opening edge of the cover 71. An annular standing wall 41*a*3 is provided at an inner peripheral edge of the first heat insulator 41*a*. Screw holes are formed at an upper end surface of the standing wall 41*a*3.

Bolts 72 (detachable mechanism) are inserted into the fastening holes of the cover 71, and the cover 71 is attached to the upper end surface of the standing wall 41*a*3 of the first heat insulator 41*a* with the bolts 72.

In the turbo-molecular pump 100 of the first variation, in a case where a predetermined amount of reactive product or more is accumulated on the cover 71, the casing 10 is detached from the temperature adjustment unit 55, and the rotary body R and the stator blades 33 are disassembled. In this manner, the cover 71 can be detached from the first heat insulator 41*a*.

In the turbo-molecular pump of the embodiment without the cover 71 as shown in FIGS. 1 and 2, the reactive product is accumulated in the region RL of the surface of the temperature adjustment spacer 24 exposed to the gas flow path, and for this reason, the temperature adjustment spacer 24 needs to be detached from the base 21 for removal of such an accumulated product and a maintenance check process is complicated.

Other configurations of the variation are similar to those of the embodiment.

Second Variation

Figure 4:
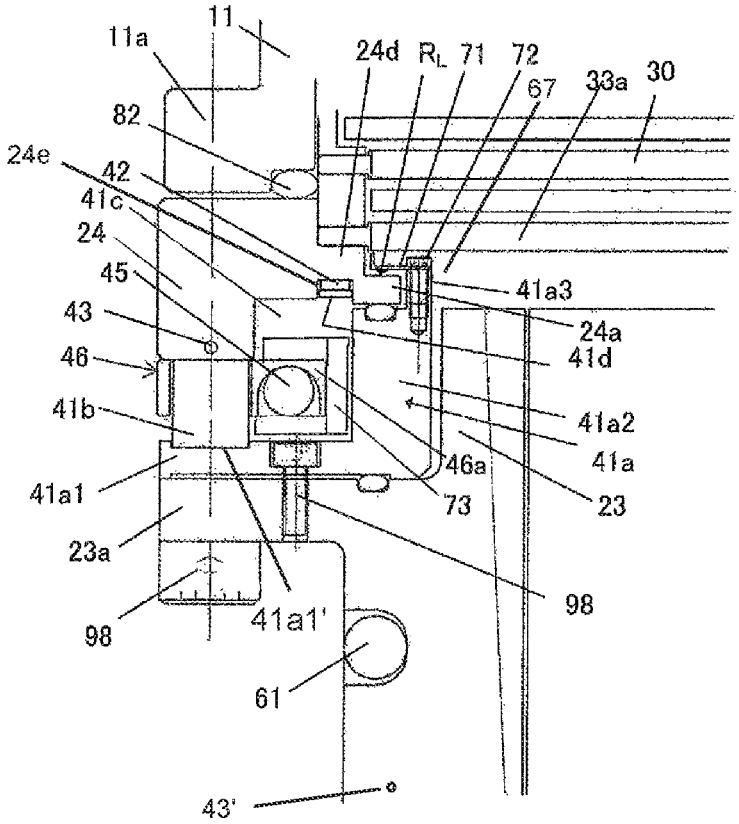
FIG. 4 is a view showing a second variation of the region II of the turbo-molecular pump according to the present invention.

FIG. 4 is a view showing a variation of the region II of the turbo-molecular pump according to the present invention. A basic configuration of the second variation is the same as the basic configuration of the first variation.

The temperature adjustment spacer 24 has a third heat insulator 73.

The third heat insulator 73 is arranged near the periphery of the coolant water pipe 45. Specifically, the third heat insulator 73 is formed in a ring shape. The third heat insulator 73 is arranged at the peripheries of the coolant water pipe 45 and the cooling spacer 46, and is arranged in close contact with each member to cover each member. The third heat insulator 73 is fixed to the cooling spacer 46 by, e.g., bonding. More specifically, the third heat insulator 73 has a first portion covering an upper portion of the housing portion 46*a* of the cooling spacer 46, a second portion covering a center-side side portion of the housing portion 46*a*, and a third portion covering a lower portion of the housing portion 46*a* and contacting a lower portion of the coolant water pipe 45.

The third heat insulator 73 reduces transfer of heat of the heater 42 and the heater 61 to the coolant water pipe 45.

The third heat insulator 73 has a silicon sponge. The silicon sponge exhibits excellent heat resistance and excellent heat insulating properties.

The third heat insulator 73 further has aluminum foil provided on a surface of the silicon sponge. That is, the third heat insulator 73 is formed of the silicon sponge with the aluminum foil. The aluminum foil may be provided on a front surface, a back surface, or both surfaces of the silicon sponge. Since the aluminum foil exhibits favorable heat shielding properties, the thickness of the silicon sponge can be reduced with the heat insulating properties being maintained and space saving can be achieved accordingly.

With the above-described configuration, an increase in the temperature of the coolant water pipe 45 is prevented. That is, pipe damage due to boiling of coolant water is less likely to be caused.

Note that specific structure, shape, and position of the third heat insulator and a relationship among the third heat insulator and other members are not specifically limited.

Note that in each of the above-described embodiments, the magnetic bearing type turbo-molecular pump 100 has been described as an example. However, the present invention can be applied to a mechanical bearing type turbo-molecular pump.

In each of the above-described embodiments, the turbo-molecular pump 100 having such a structure that the screw stator portion 26 is integrated with the housing 23 has been described as an example. However, the present invention can be applied to a turbo-molecular pump having such a structure that the screw stator portion 26 is formed as a member separated from the housing 23 and is attached to the housing 23 with a fastening member such as a bolt.

The shape of the temperature adjustment spacer 24 forming the temperature adjustment unit 55 is not limited to those of the embodiments. Moreover, the first and second heat insulators 41*a*, 41*b* are provided in the embodiments, but either one of these two heat insulators may be omitted.

Further, as long as the structure in which the base 21 is not cooled by coolant water in the coolant water pipe 45 is employed, the structure of attachment of the coolant water pipe 45 is not limited to those of the embodiments.

[Aspects]

Those skilled in the art understand that the above-described embodiments and variations are specific examples of the following aspects.

A turbo-molecular pump comprises: a turbine pump portion having rotor blades and stator blades arranged in multiple stages in an axial direction; a drag pump portion provided on a downstream side of the turbine pump portion; a case housing the turbine pump portion; a base housing the drag pump portion; and a temperature adjustment unit provided between the case and the base. The temperature adjustment unit includes a temperature adjustment spacer forming a pump casing together with the case and the base and, the temperature adjustment unit includes a cooler, a heater, and a temperature detector which are provided at the temperature adjustment spacer.

The temperatures of the multiple stages of the downstream stator blades of the turbine pump portion can be controlled with a favorable accuracy.

The heater, the temperature detector, and the cooler are arranged in this order from a lowermost stator blade of the turbine pump portion to the downstream side.

The heater, the temperature detector, and the cooler are arranged along the gas flow direction, and therefore, excessive cooling of the lowermost stator blade by the cooler is prevented, and heating of the stator blade by the heater is effective. As a result, accumulation of the reactive product on the stator blade can be effectively reduced.

The temperature detector is arranged at a position closer to the cooler than to the heater.

The temperature detector can quickly detect a decrease in the temperature of the temperature adjustment spacer by the cooler. Right after the temperature detector has detected a predetermined threshold temperature, the cooling capacity of the cooler can be decreased. High-accuracy temperature adjustment can be performed such that no reactive product is accumulated on the stator blade.

The temperature adjustment unit further has a heat insulator thermally insulating the temperature adjustment spacer from the base, and the cooler is provided between the heat insulator and the temperature adjustment spacer.

With the heat insulator, the cooler does not cool the base, and the temperature adjustment spacer can be sufficiently cooled. Thus, even if the cooler is reduced in size, the stator blade can be cooled to a proper temperature through the temperature adjustment spacer. With the heat insulator, the cooler does not cool the drag pump portion, and provides no adverse effect on accumulation of the reactive product on the drag pump portion.

The turbo-molecular pump further comprises a second heater configured to heat the drag pump portion, the second heater being provided at the base.

Accumulation of the reactive product on both of the turbine pump portion and the drag pump portion can be effectively prevented.

The base includes a first member supporting a motor configured to rotatably drive the rotor blades and a second member thermally separated from the first member and configured such that the second heater is placed at the second member.

Even if the second member is heated by the heater, the first member is not heated, and therefore, it is not necessary to suppress the motor performance.

The heater provided at the temperature adjustment unit heats the stator blades to a temperature lower than a temperature to which the drag pump portion is heated by the second heater.

The base is heated to a predetermined temperature by the heater, and accumulation of the reactive product on the drag pump portion is reduced. Moreover, the heater of the temperature adjustment unit is adjusted to a proper temperature lower than the base heating temperature. Influence on the creep deterioration of the rotor blade can be eliminated while accumulation of the reactive product on the stator blade is reliably prevented.

Drive of the heater and the cooler of the temperature adjustment unit is controlled based on a detection result of the temperature detector provided at the temperature adjustment unit.

Accumulation of the reactive product on both of the turbine pump portion and the drag pump portion can be prevented with a favorable accuracy.

The second heater is controlled based on a detection result of a second temperature detector.

a cover having a detachable mechanism is provided at a location where the temperature adjustment spacer is exposed to a gas flow path.

The turbo-molecular pump further comprises: a third heat insulator arranged near a periphery of the cooler.

The third heat insulator has a silicon sponge.

The third heat insulator further has aluminum foil provided on a surface of the silicon sponge.

The third heat insulator has a first portion covering an upper portion of the cooler, a second portion covering a center side portion of the cooler, and a third portion covering a lower portion of the cooler.

The heat insulator includes a first heat insulator which is an annular ring member having a thin eave portion and a vertical wall portion and having an inverted L-shaped section and, a second heat insulator which has a ring shape with a rectangular section, and is placed in contact with a recessed portion formed at an upper surface of the eave portion of the first heat insulator.

The temperature adjustment spacer includes a lower inner contact portion contacting the first heat insulator, a lower outer contact portion contacting the second heat insulator, and an upper contact portion contacting a flange portion of the case.

The temperature adjustment spacer includes a stator blade placing portion, and the lowermost stator blade is placed on the stator blade placing portion.

The temperature adjustment spacer includes a heater placing recessed portion, and the heater is formed in a ring shape and is provided in the recessed portion.

A heat insulator is provided on the heater.

The cooler includes a coolant water pipe. The coolant water piped is housed in a cooling spacer. The cooling spacer and the coolant water pipe are formed in ring shapes. The cooling spacer is provided in contact with the temperature adjustment spacer, so as to cool the temperature adjustment spacer.

The present invention is not limited to the contents of various embodiments and variations described above. Other aspects conceivable within the scope of the technical idea of the present invention are also included in the scope of the present invention.

What is claimed is:

1. A turbo-molecular pump comprising:

a turbine pump portion having rotor blades and stator blades arranged in multiple stages in an axial direction;

a drag pump portion provided on a downstream side of the turbine pump portion;

a case housing the turbine pump portion;

a base housing the drag pump portion; and a temperature adjustment unit provided between the case and the base, wherein the temperature adjustment unit includes a temperature adjustment spacer forming a pump casing together with the case and the base and, the temperature adjustment unit includes a cooler, a heater, and a temperature detector, a stator blade included in the turbine pump portion is placed on the temperature adjustment spacer, and the heater is placed on the temperature adjustment spacer.

2. The turbo-molecular pump according to claim 1, wherein the heater, the temperature detector, and the cooler are arranged in this order from a lowermost stator blade of the turbine pump portion to the downstream side.

3. The turbo-molecular pump according to claim 1, wherein the temperature detector is arranged at a position closer to the cooler than to the heater.

4. The turbo-molecular pump according to claim 1, wherein the temperature adjustment unit further has a first heat insulator thermally insulating the temperature adjustment spacer from the base, and the cooler is provided between the first heat insulator and the temperature adjustment spacer.

5. The turbo-molecular pump according to claim 4, further comprising a second heater configured to heat the drag pump portion, the second heater being provided at the base.

6. The turbo-molecular pump according to claim 5, wherein the base includes a first member supporting a motor configured to rotatably drive the rotor blades and a second member thermally separated from the first member and configured such that the second heater is placed at the second member.

7. The turbo-molecular pump according to claim 6, wherein the heater provided at the temperature adjustment unit heats the stator blades to a temperature lower than a temperature to which the drag pump portion is heated by the second heater.

8. The turbo-molecular pump according to claim 4, wherein the first heat insulator is an annular ring member having a thin eave portion and a vertical wall portion and having an inverted L-shaped section, and further including a second heat insulator which has a ring shape with a rectangular section, and is placed in contact with a recessed portion formed at an upper surface of the eave portion of the first heat insulator.

9. The turbo-molecular pump according to claim 8, wherein the temperature adjustment spacer includes a lower inner contact portion contacting the first heat insulator, a lower outer contact portion contacting the second heat insulator, and an upper contact portion contacting a flange portion of the case.

10. The turbo-molecular pump according to claim 1, wherein drive of the heater and the cooler of the temperature adjustment unit is controlled based on a detection result of the temperature detector provided at the temperature adjustment unit.

11. The turbo-molecular pump according to claim 10, further comprising a second heater configured to heat the drag pump portion, the second heater being provided at the base, wherein the second heater is controlled based on a detection result of a second temperature detector.

12. The turbo-molecular pump according to claim 1, wherein a cover having a detachable mechanism is provided at a location where the temperature adjustment spacer is otherwise exposed to a gas flow path.

13. The turbo-molecular pump according to claim 1, further comprising:

a third heat insulator arranged near a periphery of the cooler.

14. The turbo-molecular pump according to claim 13, wherein the third heat insulator has a silicon sponge.

15. The turbo-molecular pump according to claim 14, wherein the third heat insulator further has aluminum foil provided on a surface of the silicon sponge.

16. The turbo-molecular pump according to claim 13, wherein the third heat insulator has a first portion covering an upper portion of the cooler, a second portion covering a center side portion of the cooler, and a third portion covering a lower portion of the cooler.

17. The turbo-molecular pump according to claim 1, wherein the temperature adjustment spacer includes a stator blade placing portion, and the lowermost stator blade is placed on the stator blade placing portion.

18. The turbo-molecular pump according to claim 1, wherein the temperature adjustment spacer includes a heater placing recessed portion, and the heater is formed in a ring shape and is provided in the heater placing recessed portion.

19. The turbo-molecular pump according to claim 18, wherein a fourth heat insulator is provided on the heater.

20. The turbo-molecular pump according to claim 1, further comprising a cooling spacer, wherein the cooler includes a coolant water pipe housed in the cooling spacer, the cooling spacer and the coolant water pipe are formed in ring shapes, and the cooling spacer is provided in contact with the temperature adjustment spacer, so as to cool the temperature adjustment spacer.

* * * * *